US005215204A

United States Patent [19]

Beck et al.

[11] Patent Number: 5,215,204

[45] Date of Patent: Jun. 1, 1993

[54] TAMPER EVIDENT CLOSURE WITH HINGED BAND

[75] Inventors: James M. Beck, Carol Stream; Terry E. Kubitz, Cary; Alex Kutaj, Vernan Hills, all of Ill.

[73] Assignee: Creative Packaging Corp., Wheeling, Ill.

[21] Appl. No.: 848,253

[22] Filed: Mar. 9, 1992

[51] Int. Cl.[5] ..... B65D 41/32

[52] U.S. Cl. ..... 215/252; 215/258; 215/306

[58] Field of Search ..... 215/252, 258, 306

[56] References Cited

U.S. PATENT DOCUMENTS

| | | | |
|---|---|---|---|
| 3,904,062 | 9/1975 | Grussen | 215/258 X |
| 4,109,814 | 8/1978 | Rausing | 215/258 X |
| 4,305,516 | 12/1981 | Perne et al. . | |
| 4,394,918 | 7/1983 | Grussen . | |
| 4,418,828 | 12/1983 | Wilde et al. . | |
| 4,432,461 | 2/1984 | Mumford et al. . | |
| 4,530,436 | 7/1985 | Wiedmer | 215/252 X |
| 4,548,332 | 10/1985 | Neat | 215/252 X |
| 4,557,393 | 12/1985 | Boik | 215/252 X |
| 4,565,295 | 1/1986 | Mori et al. | 215/252 |
| 4,805,792 | 2/1989 | Lecinski, Jr. . | |
| 5,040,692 | 8/1991 | Julian | 215/252 |
| 5,056,675 | 10/1991 | Julian | 215/252 |

*Primary Examiner*—Allan N. Shoap
*Assistant Examiner*—Paul A. Schwarz
*Attorney, Agent, or Firm*—Silverman, Cass & Singer, Ltd.

[57] ABSTRACT

A closure for a container having a tamper evident band which remains on the container after the closure is removed including a substantially cylindrical end cap closed at a first end thereof by a top surface, open at a second opposite end thereof and including an annular side wall having a predetermined length extending between the first and second ends, an annular band having a first side positioned proximate the second open end of the end cap, a plurality of severable bridge members connecting the first side of the annular band to the second open end of the end cap at a plurality of predetermined positions about the periphery of the annular band and the end cap thereby forming between the bridge members a plurality of slits extending between the first side of the annular band and the second end of the end cap, a member for affixing the annular band to the container and a tether member connected between the first side of the annular band and the second open end of the end cap for providing limited movement between the annular band and the end cap during removal of the end cap, for enabling removal of the end cap from the container without distorting the end cap or the annular band, and for enabling the annular band to remain affixed to the container by the affixing member after removal of the end cap, the tether member remaining attached to both the end cap and the annular band.

7 Claims, 3 Drawing Sheets

TAMPER EVIDENT CLOSURE WITH HINGED BAND

BACKGROUND OF THE INVENTION

1. Field of the Invention

This invention relates generally to a closure for a container, and more particularly to a closure having an end cap and a tamper evident band connected to the end cap by a plurality of severable bridge portions and a non-severable tether where the bridge portions are severed during removal of the end cap from the container and the tamper evident band remains connected to the container and hingedly connected to the end cap by the non-severable tether.

2. Description of the Related Art

Closures or caps for containers typically are of the threaded screw or snap type construction and are utilized to close the mouth of the container in either a resealable or non-resealable manner. In order to provide an indication to a consumer that the cap has been tampered with and the product within the container possibly tainted, various types of tamper evident members or "pilfer bands" have been utilized in conjunction with such caps.

A simple way to provide tamper evidence for a cap is to include a pilfer band attached to the open edge of the cap where the pilfer band is broken or severed from the cap when the cap is removed. A similar type of cap is shown in U.S. Pat. No. 4,432,461 which includes a skirt or annular side wall having a ring or pilfer band connected to the open end of the skirt by a plurality of severable bridge portions where one of the bridge portions is enlarged so that it does not sever with the remaining bridge portions. Mere rotation of the cap, however, provides for removal of the pilfer ring from the container so that the pilfer ring remains connected to the cap.

U.S. Pat. No. 4,394,918 discloses another type of cap and pilfer band having a plurality of severable, and one non-severable, bridge portions where the pilfer band preferably remains attached to the container after unscrewing of the cap, but can be removed simply by exerting a pull on the unscrewed cap. When this cap is reinstalled to the container, however, a portion of the pilfer band cooperates with the severed bridge portions to space the pilfer band a slight distance from the cap and provide an indication of tampering.

Due to the easy removal of the pilfer bands from the containers, these types of closures do not provide adequate evidence of tampering. For instance, after removal of the cap and pilfer band, the severed bridge portions can be reconnected and the cap and pilfer band reinstalled on the container. In view of the recent reported instances of tampering, such recapping efforts are within the capabilities of tamperers.

It therefore is desirable to provide an end cap having a tamper evident band connected to the open end of the end cap where the band remains connected to the container and the end cap after removal of the end cap where a user will be provided evidence of tampering if the band is removed and the end cap reinstalled without the band and, since the band is not removable from the container without significant distortion of the band, reinstallation of the significantly distorted band and reconnected end cap provides clear evidence of tampering.

SUMMARY OF THE INVENTION

The invention provides a closure for a container having a tamper evident band which remains on the container after the closure is removed. The closure includes a substantially cylindrical end cap closed at a first end thereof by a top surface, open at a second opposite end thereof and including an annular side wall having a predetermined length extending between the first and second ends. An annular band is provided having a first side positioned proximate the second open end of the end cap and a plurality of severable bridge members connecting the first side of the annular band to the second open end of the end cap at a plurality of predetermined positions about the periphery of the annular band and the end cap thereby forming, between the bridge members, a plurality of slits extending between the first side of the annular band and the second end of the end cap. A member for affixing the annular band to the container also is provided as well as a tether member connected between the first side of the annular band and the second open end of the end cap for providing limited movement between the annular band and the end cap during removal of the end cap, for enabling removal of the end cap from the container without distorting the end cap or the annular band, and for enabling the annular band to remain affixed to the container by the affixing member after removal of the end cap, the tether member remaining attached to both the end cap and the annular band.

DESCRIPTION OF THE PREFERRED EMBODIMENTS

Figure 1:
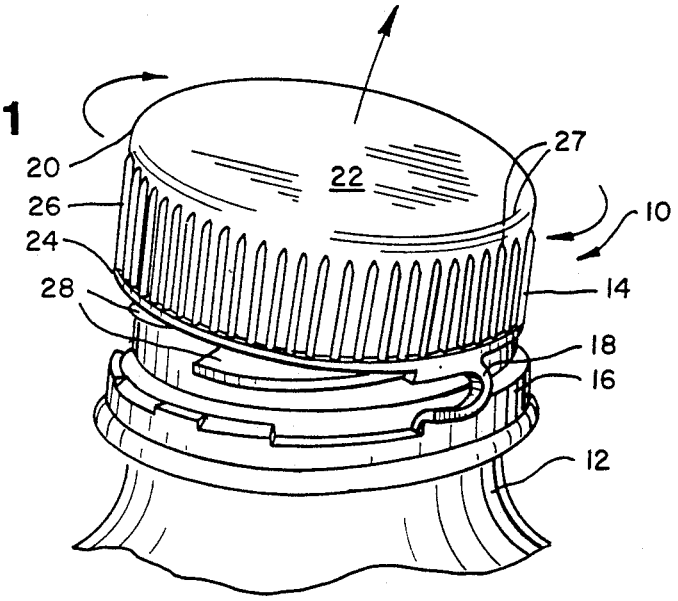
FIG. 1 is a perspective view of a container including the closure assembly of the invention illustrating the end cap being disconnected from the container.

Referring to FIGS. 1–4, an embodiment of the closure of the invention is designated generally by the reference numeral 10. Preferably, the closure 10 is made of plastic and designed for threaded engagement about the neck of a container 12 for closing the open mouth of the container 12. It is to be understood, however, that the material of the closure 10 can vary and the closure 10 can be utilized in a variety of applications.

The closure 10 includes a removable end cap 14 and a non-removable pilfer band 16 which remain connected by a tether 18 before and after removal of the end cap 14 from the container 12. As will be explained below, the pilfer band 16 securely is connected to the container 12 and cannot readily be removed from the container 12 without significant distortion of the pilfer band 16.

The end cap 14 preferably is cylindrical in shape and includes a first end 20 closed by a top surface 22, a second opposite open end 24 and an annular side wall 26 interconnecting the first end 20 and the second end 24. Preferably, to assist in gripping the end cap 14, the exterior of the side wall 26 includes ribs 27. Additionally, the interior surface of the annular side wall 26 is formed with threads (not illustrated) for cooperative threaded engagement with corresponding threads 28 formed on the container 12. If desired, the end cap 14 can be designed for snap-type engagement or a combination of threaded and snap engagement with the container 12 (not illustrated.)

Figure 2:
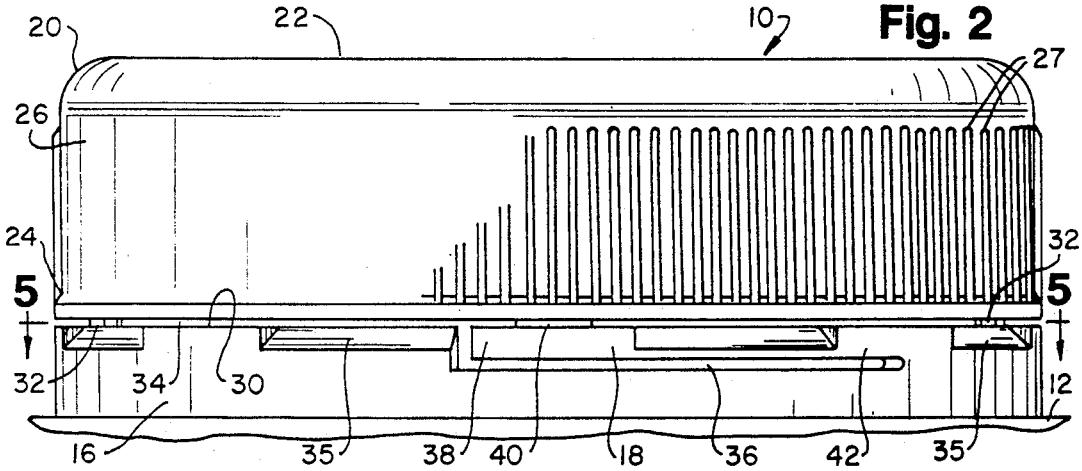
FIG. 2 is a partial elevational view of the closure assembly and container of FIG. 1 illustrating the unopened state of the closure assembly.
Figure 5:
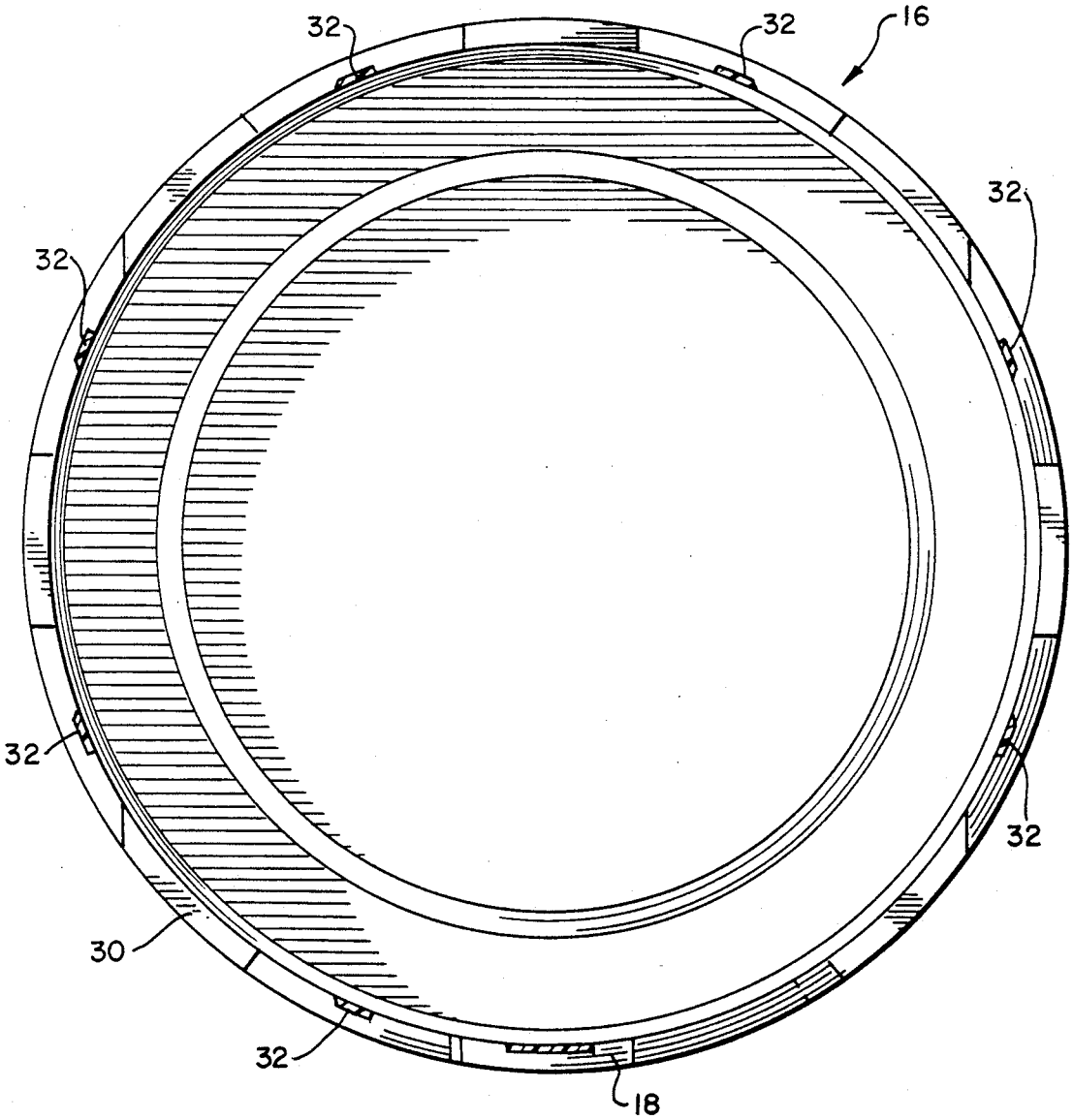
FIG. 5 is a lateral cross-sectional view of the closure assembly of the invention taken along the line 5—5 of FIG. 2 and in the direction indicated generally.

As FIGS. 2 and 5 illustrate, the second open end 24 of the end cap 14 is connected to a first end 30 of the pilfer band 16 by a plurality of severable bridge portions 32. The bridge portions 32 preferably are tapered at one end and are spaced about the circumference of the first end 30 at a plurality of predetermined positions thereby forming a plurality of through-slits 34 between the bridge portions 32 which extend between the second end 24 of the end cap 14 and the first end 30 of the pilfer band 16. As will be explained below, when the end cap 14 is unthreaded from the container 12, the bridge portions 32 are severed to enable removal of the end cap 14 from the container 12.

To assist in forming the bridge portions 32, the pilfer band 16 can include inwardly tapered portions 35 which accept a tooling member (not illustrated.) Alternatively, the bridge portions 32 and 34 can be cut with a knife blade or any other desired way.

Figure 3:
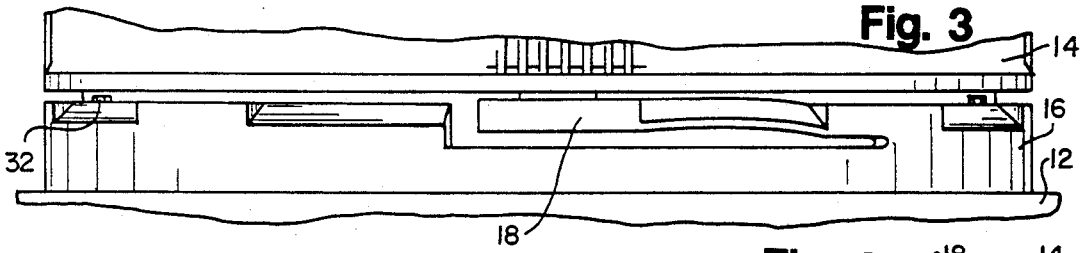
FIG. 3 is a partial elevational view of the closure assembly and container of FIG. 2 illustrating initial unthreading of the end cap from the container.
Figure 4:
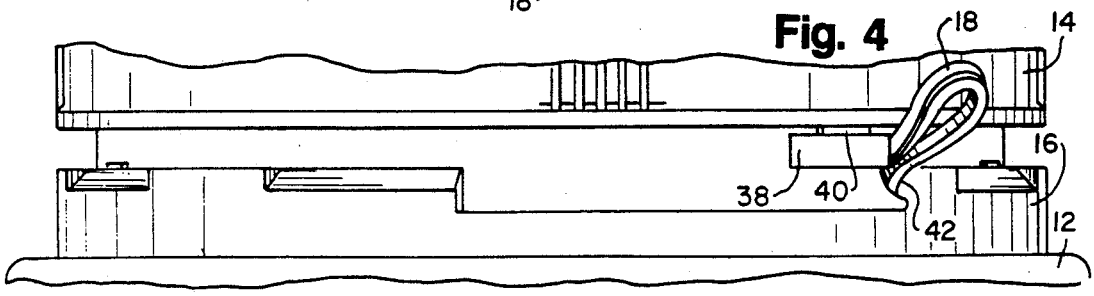
FIG. 4 is a partial elevational view of the closure assembly and container, similar to FIG. 3, illustrating continued unthreading of the end cap from the container, severing of the bridge portions and flexing of the tether.

As FIGS. 2–4 illustrate, the tether 18 is formed as a flexible strap member by a slot 36 formed in the pilfer band 16 and forms a portion 4 the first end 30 of the pilfer band 16. The tether 18 includes a first end 38, connected to the second open end 24 of the end cap 14 by a non-severable engagement portion 40 and a second opposite end 42 connected to the pilfer band 16. The slot 36 has a predetermined length extending about a portion of the periphery of the pilfer band 16 and includes first and second opposite ends.

Briefly, in operation, after the container 12 is filled with the desired contents, the closure 10 axially is forced onto the container 12 over the threads 28 until it obtains the position illustrated in FIG. 2. Upon initial unthreading of the end cap 14 to the right with respect to FIG. 2, the closure 10 achieves the position illustrated in FIG. 3 where the end cap 14 and pilfer band 16 slightly rotate and the end cap 14 slightly moves axially upward with respect to the container 12 by means of the threaded engagement. Accordingly, the bridge portions 32 sever and the tether 18 begins to flex or bow outward enabling the desired axial and rotational movement. Upon continued unthreading of the end cap 14, the closure achieves the position illustrated in FIG. 4 where the tether 18 flexes further outward but still remains connected to the end cap 14 by its first end 38 through the non-severable engagement portion 40 and to the pilfer band 16 by its second end 42. Upon further unthreading and axial movement of the end cap 14, the closure 10 achieves the position illustrated in FIG. 1 where the end cap 14 can be removed from the container 12 with the tether 18 still connected between the end cap 14 and the pilfer band 16.

Thereafter, the contents within the container 12 can be dispensed as desired with the end cap 14 remaining attached to the pilfer band 16, and thus the container 12, to prevent misplacement of the end cap 14. When dispensing is completed, the end cap 14 can be rethreaded onto the container 12 without breaking the tether 18. If desired, the end cap 14 can be removed from the pilfer band 16 by cutting the tether 18 or exerting a significant pull on the end cap 14 which permanently deforms the tether 18 before it is severed from the pilfer band 16.

Accordingly, evidence of tampering is provided in one of two ways. First, the user can be provided with a warning not to use the contents of the container 12 if the pilfer band 16 is not on the container 12. Thus, tampering by removing the end cap 14 and pilfer band 16, cutting the tether 18 from the end cap 14 and then reinstalling just the end cap 14 will be hampered. Second, tampering by removing the end cap 14 and pilfer band 16, reconnecting the bridge portions 32 and reinstalling both the end cap 14 and the pilfer band 16 to the container 12 also will be hampered. Specifically, due to the attachment of the pilfer band 16 to the container 12, as will be described below with regard to the embodiment of FIGS. 6–11, the pilfer band 16 cannot be removed without causing visible damage thereto. Additionally, the outward flexing of the tether 18 during unthreading of the end cap 14 causes visible distortion of the tether 18. Accordingly, with the closure 10, not only can the end cap 14 be retained to reduce misplacement, but clearly visible evidence of tampering is provided.

FIGS. 6–11 illustrate an alternate embodiment of the invention where common elements are referred to by the same reference numerals. In this embodiment, the closure 110 includes an end cap 114, pilfer band 116 and tether 118 where the tether 118 is modified from the tether 18 of the embodiment of FIGS. 1–5.

Figure 9:
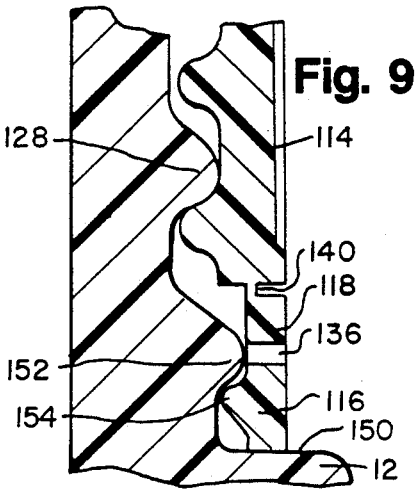
FIG. 9 is a fragmentary sectional view of the closure assembly of the invention illustrating the position of the threads of the end cap and the container neck in the unopened position shown in FIG. 6.
Figure 10:
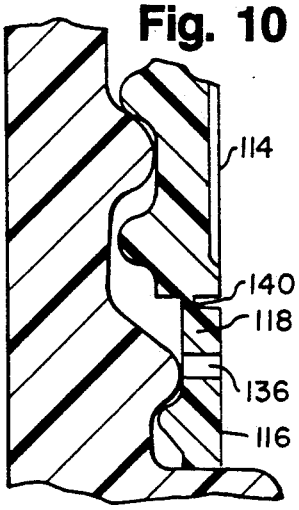
FIG. 10 is a fragmentary sectional view of the closure assembly of the invention illustrating the position of the threads of the end cap and the container neck during initial rotation of the end cap and flexing of the tether as shown in FIG. 7.
Figure 11:
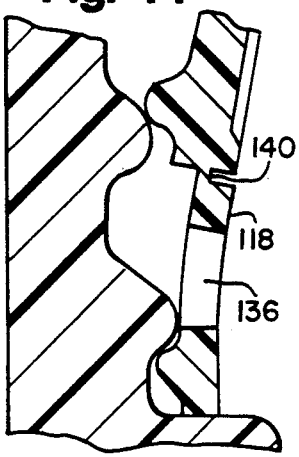
FIG. 11 is a fragmentary sectional view of the closure assembly of the invention illustrating the position of the threads of the end cap and the container neck during further rotation and removal of the end cap and flexing of the tether as shown in FIG. 8.

FIGS. 9–11 illustrate the connection between the pilfer band 116 and the container 12. Preferably, the container 12 includes one or more threads 128, an annular shoulder 150 and an annular flange 152 which is designed for cooperative snapping engagement between an interior annular rib 154 formed on the inside surface of the pilfer band 116. Accordingly, during assembly of the closure 110 to the container 12, the rib 154 is forced over the flange 152 and the pilfer band 116 rests on the shoulder 150. Due to the close cooperative engagement between the flange 152 and the rib 154 and the seating of the pilfer band 116 on the shoulder 150, it is difficult to remove the pilfer band 116 from the container 12 without significant distortion of the pilfer band 116. This inhibits a tamperer from reinstalling the end cap 114 with reattached pilfer band 118 as described above.

Figure 6:
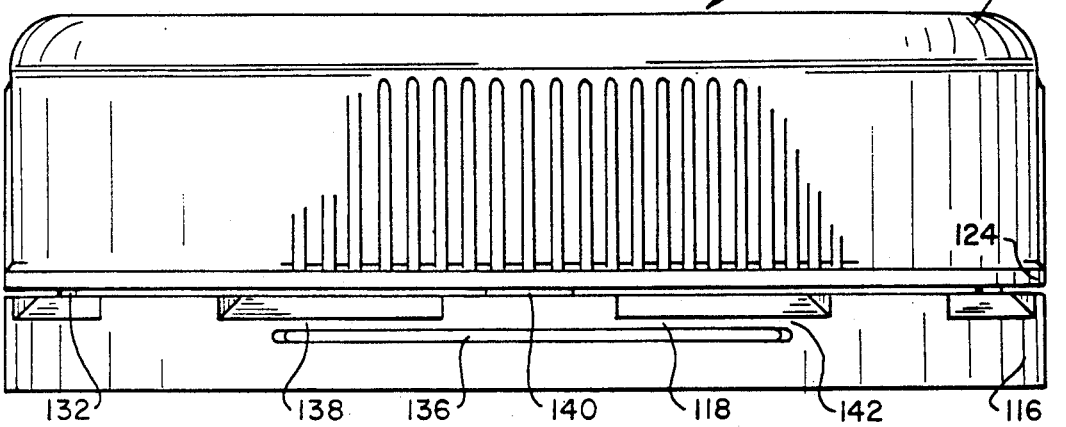
FIG. 6 is an elevational view of another embodiment of the closure assembly of the invention in its unopened position.
Figure 7:
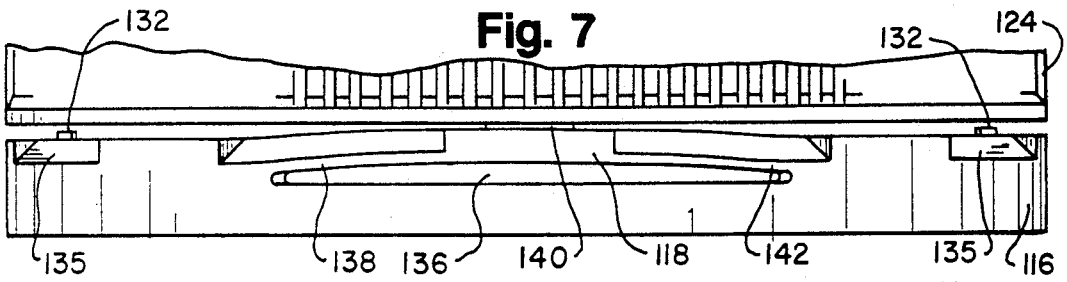
FIG. 7 is a partial elevational view of the closure assembly of FIG. 6 illustrating initial severing of the bridge portions and flexing of the tether which occurs during initial rotation of the closure with respect to a container neck.
Figure 8:
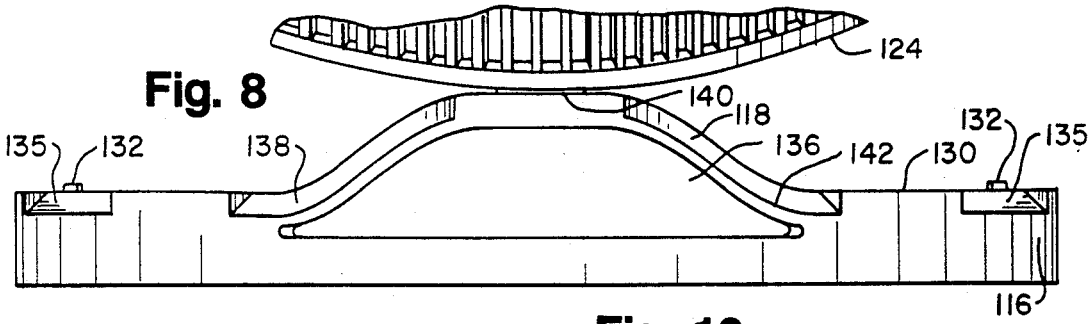
FIG. 8 is a partial elevational view of the closure assembly, similar to FIG. 7, illustrating further flexing of the tether which occurs during further rotation and removal of the closure from the container neck.

As FIGS. 6–8 illustrate, the first and second ends 138 and 142 of the tether 118 both are connected to the pilfer band 116 and the slot 136 is closed at both ends to form the tether 118. The tether 118 includes an engagement portion 140 for connection to the second open end 124 of the end cap 114 which is positioned intermediate the first and second ends 138 and 142 of the tether 118.

Accordingly, the closure 110 initially is positioned as illustrated in FIGS. 6 and 9. Upon initial unthreading of the end cap 114, the pilfer band 116 slightly rotates with the end cap 114 and the end cap 114 slightly moves axially upward away from the pilfer band 116 to sever the bridge portions 132 and flex the tether 118 as illustrated in FIGS. 7 and 10. Upon continued unthreading of the end cap 114, the tether 118 flexes to the position illustrated in FIGS. 8 and 11 where the end cap 114 can be removed from the container 12 with the tether 118 still attached to the end cap 114 and the pilfer band 116.

It is to be noted that in the embodiment of FIGS. 6–11 the tether 118 is modified and provides only axial movement of the end cap 114 with respect to the pilfer band 118. The installation and operation of the embodiment of FIGS. 6–11 otherwise is the same as in the embodiment of FIGS. 1–5.

Modifications and variations of the present invention are possible in light of the above teachings. A specific dimension, material or construction is not required so long as the assembled device is able to function as herein described. It is therefore to be understood that within the scope of the appended claims, the invention may be practiced otherwise than as specifically described.

What is claimed and desired to be secured by Letters Patent of the United States is:

1. A closure for a container having a tamper evident band which remains on the container after the closure is removed, comprising:

a substantially cylindrical end cap closed at a first end thereof by a top surface, open at a second opposite end thereof and including an annular side wall having a predetermined length extending between said first and second ends;

an annular band having a first end positioned proximate said second open end of said end cap a plurality of severable bridge means directly connecting said first end of said annular band to said second open end of said end cap at a plurality of predetermined positions about the periphery of said annular band and said end cap thereby forming, between said bridge means, a plurality of slits extending between said first end of said annular band and said second end of said end cap;

means for axially affixing said annular band to the container at a predetermined initial axial installment position with respect to the container and restricting axial movement of said annular band during removal of said end cap; and tether means connected between said annular band and said second open end of said end cap for providing limited movement between said annular band and said end cap during removal of said end cap, for enabling removal of said end cap from the container without distorting said end cap or said annular band, and for enabling said annular band to remain affixed to the container by said means for affixing after removal of said end cap, said tether means remaining attached to both said end cap and said annular band, said tether means including an elongate flexible strap member having a first end connected to said second open end of said end cap and a second opposite end connected to said annular band.

2. The closure as defined in claim 1 wherein said strap member is formed as a portion of said first end of said annular band by a slot formed in said annular band and forms a portion of said first end of said annular band, said slot having a predetermined length extending about a portion of the periphery of said annular band and having first and second opposite ends, said first ends of said slot being open to one of said slits to form said first end of said strap and said second end of said slot being closed by a portion of said annular band to form said second end of said strap.

3. The closure as defined in claim 1 wherein said tether means enable axial movement between said end cap and said annular band.

4. The closure as defined in claim 1 wherein said tether means enable rotational movement between said end cap and said annular band.

5. The closure as defined in claim 1 wherein said tether means enable both axial and rotational movement between said end cap and said annular band.

6. A closure for a container having a tamper evident band which remains on the container after the closure is removed, comprising:

a substantially cylindrical end cap closed at a first end thereof by a top surface, open at a second opposite end thereof and including an annular side wall having a predetermined length extending between said first and second ends;

an annular band having a first end positioned proximate said second open end of said end cap;

a plurality of severably bridge means connecting said first end of said annular band to said second open end of said end cap at a plurality of predetermined positions about the periphery of said annular band and said end cap thereby forming, between said bridge means, a plurality of slits extending between said first end of said annular band and said second end of said end cap;

means for affixing said annular band to the container; and tether means connected between said annular band and said second open end of said end cap for providing limited movement between said annular band and said end cap during removal of said end cap, for enabling removal of said end cap from the container without distorting said end cap or said annular band, and for enabling said annular band to remain affixed to the container by said means for affixing after removal of said end cap, said tether means remaining attached to both said end cap and said annular band and including an elongate flexible strap member having first and second opposite ends connected to said annular band and connected to said second open end of said end cap at a position intermediate said first and second ends of said flexible strap member.

7. The closure as defined in claim 6 wherein said strap member is formed as a portion of said annular band between a slot formed in said annular band and end first side of said annular band, said slot having a predetermined length extending about a portion of the periphery of said annular band and first and second opposite ends closed by respective portions of said annular band.

* * * * *

UNITED STATES PATENT AND TRADEMARK OFFICE

CERTIFICATE OF CORRECTION

PATENT NO. : 5,215,204

DATED : June 1, 1993

INVENTOR(S) : Paul A. Schwarz

It is certified that error appears in the above-identified patent and that said Letters Patent is hereby corrected as shown below:

Column 3, line 61, "4" should be --of--;

Column 6, line 14, "ends" should be --end--;

Column 6, line 38, "severably" should be --severable--;

Column 6, lines 63-64, "end first side" should be --said first end--.

Signed and Sealed this

Twenty-fifth Day of January, 1994

Bruce Lehman

*Attest:*

BRUCE LEHMAN

*Attesting Officer*

*Commissioner of Patents and Trademarks*